US005267702A

United States Patent [19]

Schumacher et al.

[11] Patent Number: 5,267,702

[45] Date of Patent: Dec. 7, 1993

[54] DEVICE FOR WINDING AND UNWINDING CABLES ONTO A CABLE DRUM

[75] Inventors: Heinz J. Schumacher, Stolberg-Mausbach; Karl-Heinz Klein, Roetgen, both of Fed. Rep. of Germany

[73] Assignee: Stolberger Maschinenfabrik GmbH & Co. KG, Stolberg, Fed. Rep. of Germany

[21] Appl. No.: 849,418

[22] PCT Filed: Jul. 25, 1991

[86] PCT No.: PCT/EP91/01392

§ 371 Date: Apr. 28, 1992

§ 102(e) Date: Apr. 28, 1992

[87] PCT Pub. No.: WO90/15771

PCT Pub. Date: Dec. 27, 1990

[30] Foreign Application Priority Data

Aug. 28, 1990 [DE] Fed. Rep. of Germany ..... 4027131

[51] Int. Cl.[5] ..... B65H 75/00; B65H 54/553

[52] U.S. Cl. ..... 242/54 R; 240/129.51

[58] Field of Search ..... 242/54 R, 58.6, 79, 242/68.4, 129.51, 85

[56] References Cited

U.S. PATENT DOCUMENTS

| | | | |
|---|---|---|---|
| 2,490,685 | 12/1949 | Greene | 242/58.6 X |
| 3,687,385 | 8/1972 | Skalleberg | 242/54 R |
| 4,098,468 | 7/1978 | Skalleberg | 242/54 R |
| 4,209,140 | 6/1980 | Seibert | 242/58.6 X |
| 4,679,743 | 7/1987 | Dallmaier | 242/54 R |

FOREIGN PATENT DOCUMENTS

| | | |
|---|---|---|
| 0202520 | 5/1987 | European Pat. Off. . |
| 2713866 | 10/1977 | Fed. Rep. of Germany . |
| 9015771 | 12/1990 | PCT Int'l Appl. . |

*Primary Examiner*—John M. Jillions

*Attorney, Agent, or Firm*—Spencer, Frank & Schneider

[57] ABSTRACT

A device for winding and unwinding cables onto a cable drum (9) includes a portal-like supporting frame (1) and bracket arms (4) suspended from it. The bracket arms (4) are adjustable in length, and the distance between the bracket arms (4) is also adjustable. Rotatable spindle pins (8) are carried at the lower ends of the bracket arms (4). The bracket arms (4) are configured to be freely resilient in the longitudinal direction, and furthermore the spindle pins (8) are held at the bracket arms (4) so as to be movable transversely thereto. As a result, insertion of the spindle pins (8) into receiving openings in the cable drums is facilitated so that automatic operation is possible practically without malfunction even if there are dimensional errors in the receiving openings of the cable drums.

9 Claims, 4 Drawing Sheets

DEVICE FOR WINDING AND UNWINDING CABLES ONTO A CABLE DRUM

BACKGROUND OF THE INVENTION

The invention relates to a device for winding and unwinding cables onto a cable drum, the device including a portal-like supporting frame which is provided with two bracket arms that are suspended from a transverse crossbar and are adjustable in their distance from one another. Each arm includes a stationary arm portion and at least one arm portion that can be moved longitudinally in the manner of a telescope and by way of a lifting drive from a lower receiving position into an upper winding position. A rotatably mounted spindle pin arranged to receive the cable drum and oriented toward the other bracket arm is disposed at the free end of each longitudinally movable arm portion.

A device of the above described type is disclosed in U.S. Pat. No. 3,687,385. The advantage of this known winding device is that the bracket arms are always able to accommodate cable drums of any desired size within certain diameter ranges starting from a predetermined winding position defined by the shortest arm length. The drawback of the prior art device is that the bracket arms, except for their telescope-like longitudinal mobility and the spindle pins, are of a rigid construction so that cable drum and winding device must be accurately aligned with one another in order to be able to introduce the spindle pins into the central bores of the cable drum to pick up the drum. Positioning devices conceivable for large cable drums offer no solution, particularly if, for example, in connection with heavy cable drums made of wood, the lateral delimiting discs are offset relative to one another after repeated use and the lateral openings at the cable drum itself are no longer flush with one another.

German Unexamined Published Patent Application DE-OS 2,713,866 discloses a winding device for cables in which a support provided at each one of two vertical lateral supports is guided so as to move up and down and wherein the spindle pins are suspended in the support in a pendulum fashion, with each support being provided with its separate drive with the aid of which the spindle pin is raised by a small amount and is thus arrested with respect to its pendulum movement. The supports are then raised as a whole by their drives to the predetermined winding position. The prior art device is very expensive and requires additional controls for the actuation of the individual functions.

SUMMARY OF THE INVENTION

It is now an object of the invention to improve a device for winding and unwinding cables of the above-mentioned type so that it is possible without additional drive means to accommodate cable drums in which the lateral openings are not exactly flush.

This is accomplished according to the invention in that at least a portion of each bracket arm is resiliently supported, in the unloaded state, independently of the lifting drive so as to be movable back and forth within limits in its longitudinal direction relative to the supporting frame; each spindle pin is movable back and forth within limits transversely to the longitudinal direction of the associated bracket arm; and locking means are provided to arrest the longitudinal movement at the bracket arm and the transverse movement of the spindle pin in the winding position. If a cable drum is disposed between the two bracket arms which have been moved apart with respect to their spacing from one another and have been extended in the manner of a telescope into the lower receiving position, then movement of the bracket arms toward one another to the distance between the spindle pins as predetermined by the width of the cable drum, enables the spindle pin on each side to automatically thread itself into the associated receiving opening in the cable drum. The free upward and downward mobility of the bracket arms in the longitudinal direction, on the one hand, and the possible movement of the spindle pins transversely thereto, on the other hand, here ensure, in connection with the conically tapered spindle pin, the necessary transverse mobilities. As soon as the spindle pins are threaded on both sides, the lifting drive of the telescope-like arm portion raises it into the winding position defined by the lower end of the arm portion connected with the supporting frame, with the limited longitudinal movement of the bracket arm, on the one hand, and the transverse movement of the spindle pin, on the other hand, being prevented by appropriate locking means. Longitudinal and transverse movement may be accomplished, for example, in that the stationary arm portion is connected by way of a spring element with the crossbar which permits free resiliency toward the top and bottom in the unloaded state, with pivoting movements relative to the spindle pin also being possible by way of a corresponding pivoting movement of the entire bracket arm. If the longitudinally displaceable telescoping arm is raised into the winding position by way of the driving device, for example an adjustment spindle, then the spring element is compressed when the winding position is reached and thus the upper end of the bracket arm is drawn into a lock opening so that a rigid connection is then produced between the transverse crossbar and the bracket arm.

A preferred feature of the invention provides that each spindle pin is connected with the free end of the longitudinally movable arm portion so as to be pivotal transversely to the longitudinal direction of the bracket arm and that locking means are disposed at the free end of the stationary arm portion for fixing the spindle pin in the winding position. With this arrangement, the limitedly resilient longitudinal movement of the bracket arm, on the one hand, and the transverse movement of the spindle pin, on the other hand, are separated from one another so that the locks can be simplified with respect to the moments to be absorbed. However, in this embodiment as well, the arrangement is such that when the winding position is reached with the aid of the lifting drive, that is, without additional drive means, the longitudinal movement of the bracket arm as well as the transverse movement of the spindle pin are locked.

As a further advantageous feature of the invention it is provided that a further arm portion in the form of a telescoping guide is disposed at the free end f the longitudinally movable arm portion and a supporting pin connected with the bearing housing of the spindle pin is guided in the telescoping guide so as to be longitudinally movable and is supported by spring elements at the telescoping guide. This configuration has the advantage that the limited spring movement in the longitudinal direction of the arm as well as the transverse movement of the spindle pin relative thereto take place in the region of the free end of the bracket arm. The spring elements required for the longitudinal movement, since they need carry a significantly lower weight, can be made very much weaker so that the spring forces to be overcome during "threading" into the holes on the sides of the cable drum and thus the transverse forces generated thereby are significantly lower.

As a further advantageous feature it is here provided that the telescoping guide and the support pin are connected with the longitudinally movable arm portion so as to be pivotal about a horizontal axis. This permits a simple and compact structure since only appropriate bearing pins are required for the pivoting movement between the telescoping guide and the free end of the movable arm portion.

Another feature of the invention provides that the bearing housing of the spindle pin is connected with the portion of the support arm that is longitudinally movable in a limitedly resilient manner so that the spindle pin is able to pivot about a vertical axis. This solution can be employed for configurations in which the bracket arm as a whole is connected with the supporting frame so as to be resilient in the longitudinal direction and in arrangements in which the displaceable arm portion is resiliently supported or a resiliently configured telescoping guide is provided at the free end of the displaceable arm portion. An advisable feature of the invention further provides that centering springs support the spindle pin in its center position with respect to its pivoting movement. This arrangement is of particular advantage if the bearing housing of the spindle pin is connected with the bracket arm so as to be pivotal about a vertical axis. In this way it is ensured that in the receiving position the tips of the spindle pins are oriented opposite one another in a precisely flush alignment.

A further feature of the invention provides that the vertical pivot axis of the bearing housing is disposed at the end of the bearing housing facing away from the tip of the spindle pin and the end facing the spindle pin is supported in a link-shaped opening in the arm portion.

Another advantageous feature of the invention provides that the locking means for fixing the movement of the spindle pins is formed in each case by a fork-shaped attachment which is open toward the free bracket arm end on the stationary arm portion. When the winding position is reached, this fork-shaped attachment grips around the bearing housing of the spindle pin. In this way, on the one hand, transverse movement of the spindle pin is prevented and, on the other hand, an abutment is formed because of which the spring permitting limited longitudinal movement is compressed as a result of the remaining movement of the lifting drive and thus this possible movement is also suppressed.

Another advisable feature of the invention provides that the spindle pin is spherical in the region of its largest diameter. This configuration offers the advantage that even if the receiving holes in the side discs of the cable drum are not flush, the spindle pin can be pushed into the side openings without force when the two bracket arms are moved toward one another so that during the later lifting the cable drum is able to align itself properly.

BRIEF DESCRIPTION OF THE DRAWINGS

The invention will now be described in greater detail with respect to schematic drawings of embodiments thereon, in which.

DESCRIPTION OF THE PREFERRED EMBODIMENTS

Figure 1:
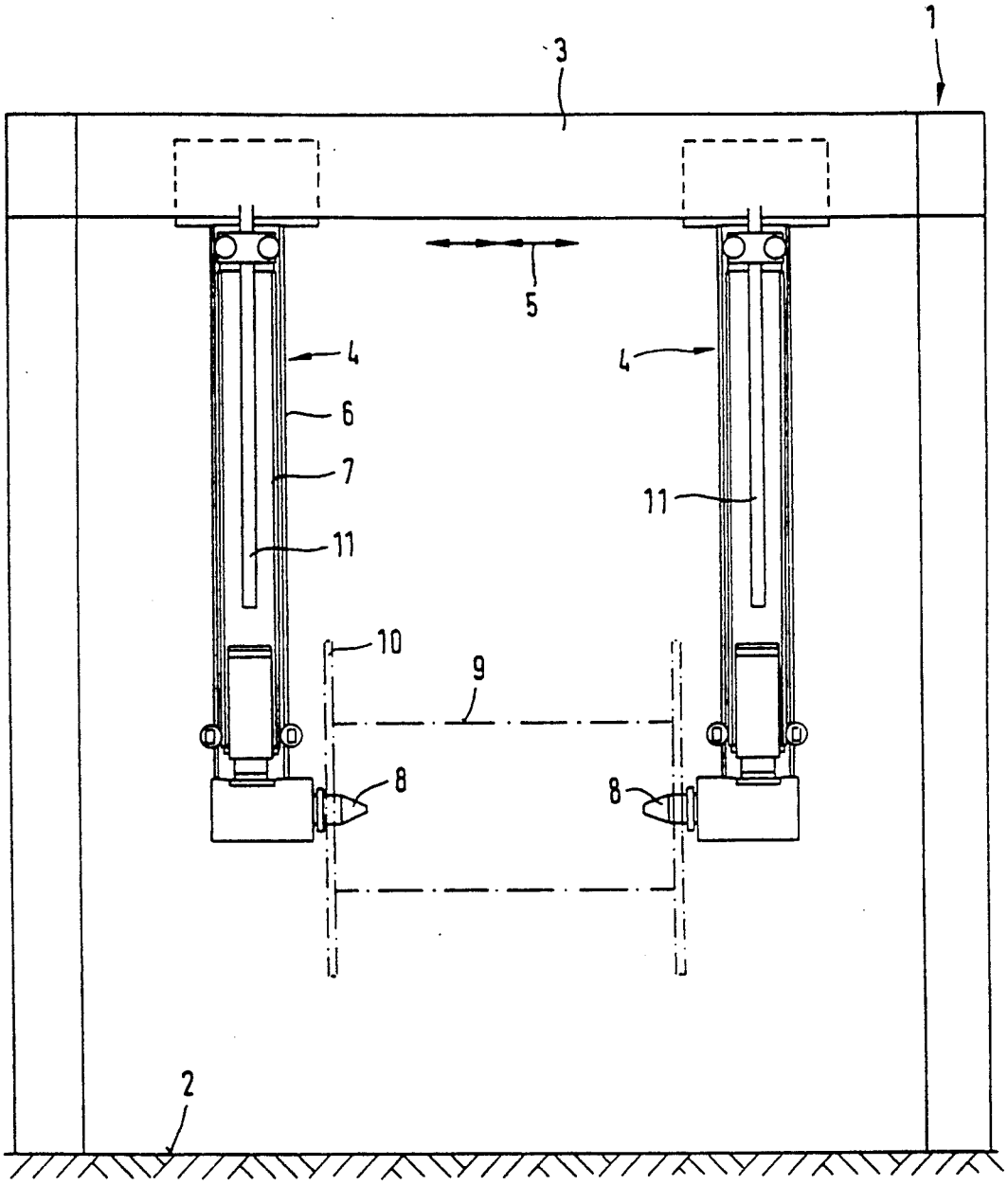
FIG. 1 shows a winding device in the winding position.

The winding device shown in FIG. 1 includes a supporting frame 1 which either—as shown—may be fixed to the floor or bottom 2 of a housing or may be provided with a travelling mechanism, not shown in detail here. Two bracket arms 4 are displaceably mounted at a transverse crossbar 3 of supporting frame 1 and are movable in a mirror image to the center axis of supporting frame 1 (double arrow 5) by means of a drive, not shown in detail here, for example a spindle having clockwise and counterclockwise threads.

Bracket arms 4 are each composed of a stationary arm portion 6 and a telescope-like longitudinally movable arm portion 7 that is guided in stationary arm portion 6 and at whose free end a spindle pin 8 is rotatably mounted. Spindle pins 8 may be guided by the above-described transverse movement in the direction of arrow 5 toward a cable drum 9 positioned between both bracket arms 4 and may each be inserted into the side hole of the respective side disc 10 of cable drum 9. In the illustrated embodiment, the movement of longitudinally movable arm portion 7 is effected by way f a lifting spindle 11 which is connected with a corresponding lifting drive not shown in detail here. The lifting drive is configured in such a way that the lifting spindles 11 of both bracket arms 4 can be driven in synchronism. The lifting movement will be described in detail with reference to FIGS. 2A, 2B and 2C.

Figure 2C:
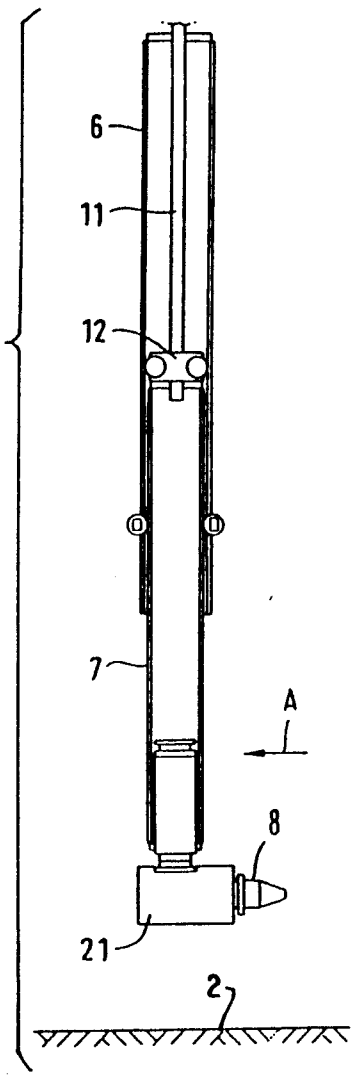
FIGS. 2A, 2B and 2C shows a bracket arm of the winding device of FIG. 1 in the winding position and in two different receiving positions.
Figure 2B:
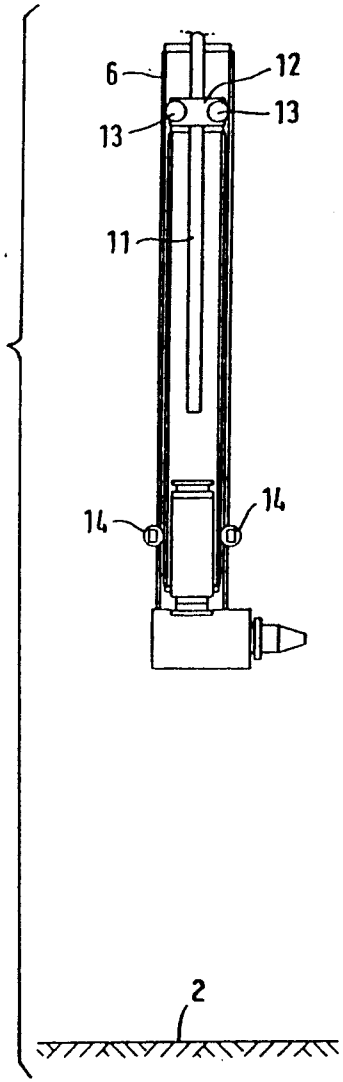
Figure 2A:
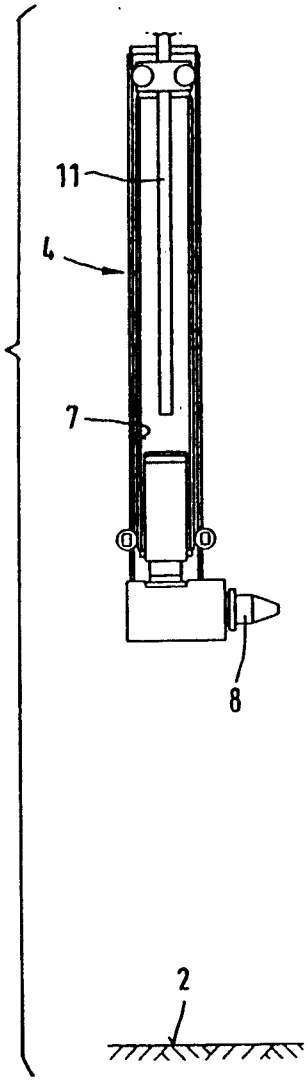

FIGS. 2A-2C show a bracket arm 4 in different operating positions. In FIG. 2A, bracket arm 4 is shown in the winding position, that is, spindle pin 8 has reached its highest position above floor 2, i.e., the longitudinally movable arm portion 7 is held at the highest possible position by the lifting drive for lifting spindle il.

In FIG. 2B, the movable arm portion 7 is lowered by a small amount. This position shows the receiving position for the largest possible cable drums, that is, the position in which spindle pin 8—as will be described in detail below —is unlocked with respect to its mobility. This illustration also shows that the lifting spindle 11 is held in a spindle nut 12 which is fastened to the upper end of the longitudinally movable arm portion 7 and which is supported on the interior of stationary arm portion 6 by way of supporting rollers 13. At the lower end of the stationary arm portion 6, supporting rollers 14 are disposed which project into the interior through corresponding recesses and support the longitudinally movable arm portion 7 in this region.

In FIG. 2C, bracket arm 4 has been extended to its longest possible length and is depicted in the receiving position for the smallest possible cable drum diameter.

Figure 3:
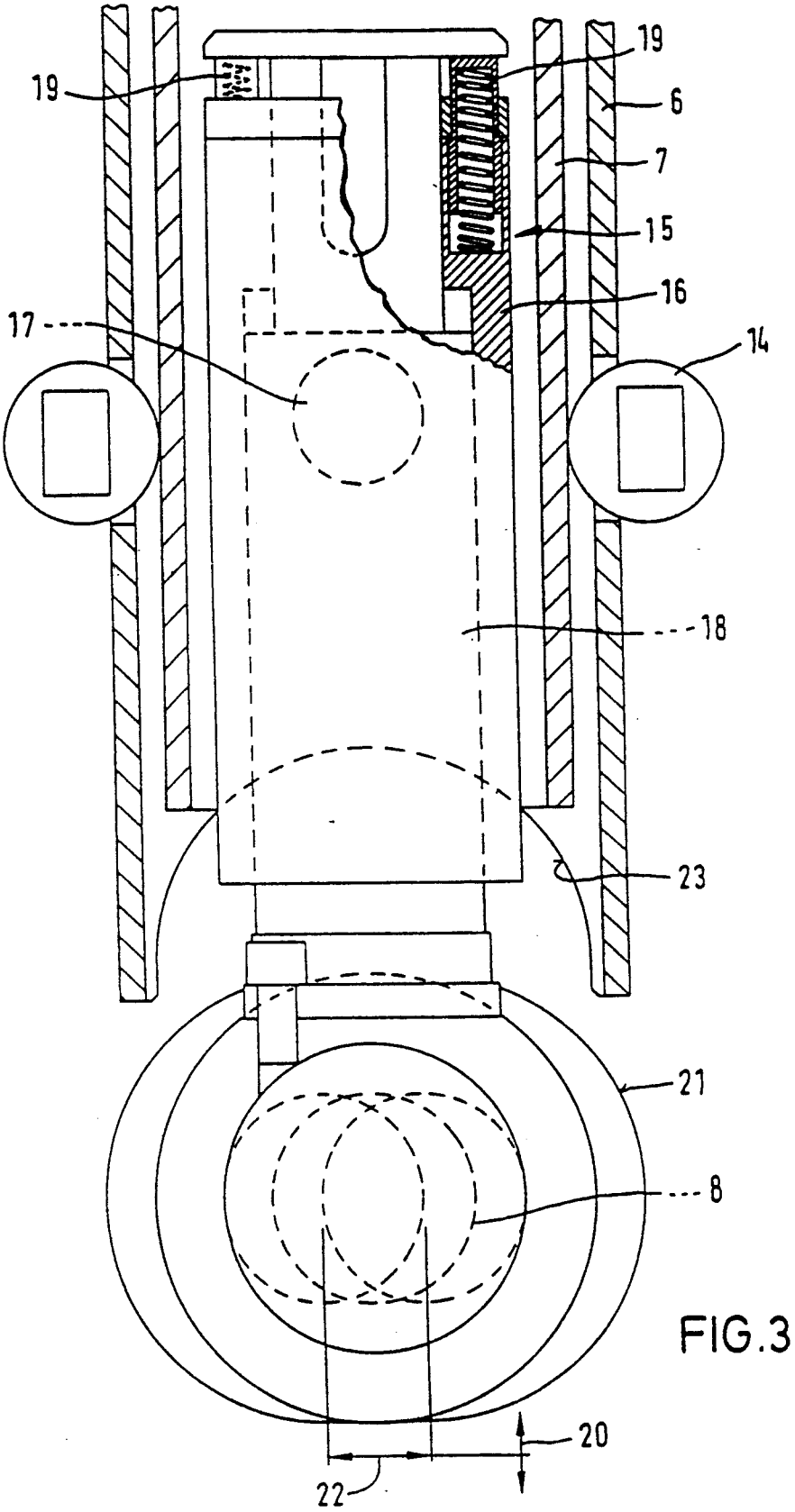
FIG. 3 shows a front view of the free end of a bracket arm (arrow A in FIG. 2C, partially in section)

FIG. 3 shows, in the direction of arrow A of FIG. 2C and to a larger scale, the configuration of the spindle pin mount in greater detail. In this arrangement, a further telescoping arm portion 15 is provided at the free end of longitudinally movable arm portion 7. An outer arm portion 16 here has a tubular configuration and is held at longitudinally movable arm portion 7 so as to be pivotal back and forth in the plane of the drawing by way of a pivot pin 17. In the outer portion 16, a supporting pin 18 is guided so as to be longitudinally movable but secured against twisting. The upper end of supporting pin 18 is supported by way of spring elements 19 on the tubular portion 16 so that the supporting pin 18 is able to resiliently move up and down over the length indicated by arrow 20. The supporting pin 18 is connected with a bearing housing 21 in which spindle pin 8 is rotatably mounted. Due to the pendulum-like suspension, spindle pin 8 is able to pivot back and forth around the center position by the degree indicated by double arrow 22.

In order to receive a cable drum 9, the spindle pins 8 of the moved-apart bracket arms 4 are lowered to the required height. Then the two bracket arms 4 are moved toward one another. Since spindle pins 8 are movably connected with bracket arms 4 in the direction of arrow 20 as well as in the direction of arrow 22 (FIG. 3), spindle pins 8 are able to thread themselves between the receiving openings in the side discs 10 of cable drum 9 even if there are alignment errors. If the two longitudinally displaceable arm portions 7 are raised by lifting spindle 11 into the winding position shown in FIG. 2A, spring elements 19 at the further arm portion 15 are initially compressed due to the weight of the cable drum so that the spindle pin 8 is arrested with respect to its free longitudinal mobility.

When the winding position shown in FIG. 2A is reached, lifting spindle 11 draws the bearing housing 21 of spindle pin 8 into a claw-shaped recess 23 at stationary arm portion 6 so that this recess 23 now grips completely around bearing housing 21. In this position the bearing housing 21 is thus locked relative to a free transverse movement with respect to bracket arm 4. In this position, the winding process may then take place.

Figure 5:
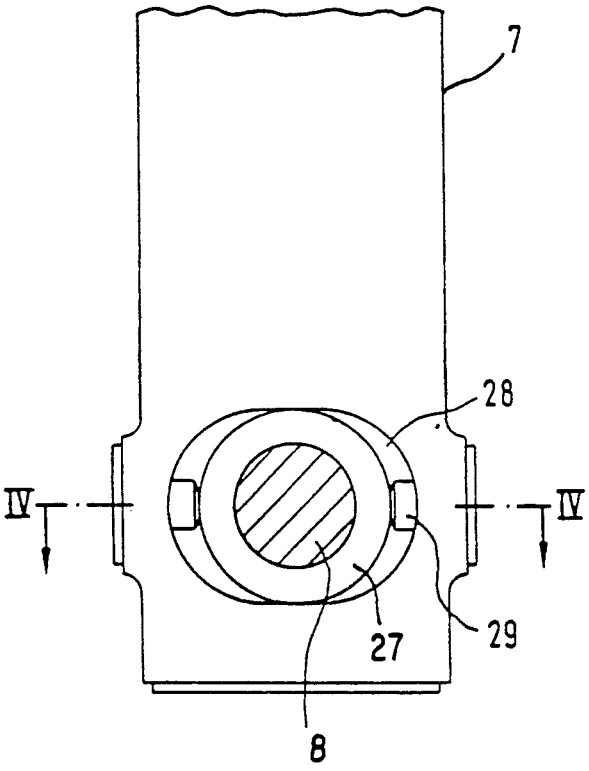
FIG. 5 shows a front view, partially in section taken along line V—V of FIG. 4, of a portion of the second embodiment.
Figure 4:
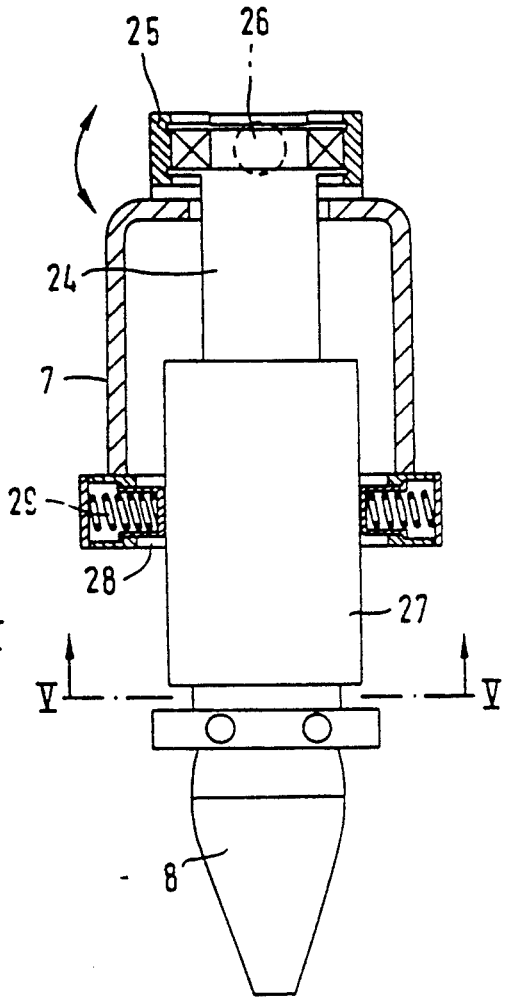
FIG. 4 is a top view, partially in section taken along line IV—IV of FIG. 5, showing a spindle pin mounted in accordance with a second embodiment.

FIGS. 4 and 5 show another embodiment of the spindle pin bearing. While in the embodiment shown in FIG. 3, transverse movement of spindle pin 8 is effected by pivoting about the horizontal axis defined by pivot pin 17, in the embodiment described with reference to FIGS. 4 and 5 the arrangement is such that spindle pin 8 is pivotal about a vertical axis. For this purpose, the rear end of spindle pin shaft 24 is mounted so as to rotate in a bearing housing 25 which in turn is horizontally pivotal relative to the longitudinally movable arm portion 7 about a vertically aligned pivot pin 26. The end of pin shaft 24 facing spindle pin 8 is supported in a bearing housing 27 which in turn is supported in a connecting link guide 28. Connecting link guide 28 has long cavity which, at each end face, is provided with a compression spring bushing 29 of such a configuration that spindle pin 8 is again able to pivot back and forth somewhat in the horizontal direction. In the embodiment according to FIG. 3, the spindle pin is centered by gravity while, in the embodiment according to FIGS. 4 and 5, centering occurs by way of the two compression spring bushings 29. The limitedly resilient movement in the longitudinal direction of arm portion 7 can take place—as described in connection with FIG. 3—by way of a further arm portion 15 equipped with a telescoping guide or by a resilient support of the bracket arm itself. This is possible, for example, in that an appropriate supporting spring (not illustrated) is disposed between the longitudinally displaceable arm portion 7 and the spindle nut 12 connected therewith so as to ensure a limited amount of free upward and downward mobility. If, after insertion of spindle pins 8 into the holes of the side discs 10 of a cable drum 9, the cable drum 9 is raised, then the spring elements are initially compressed—as described above—and the limited mobility in the vertical direction is prevented. In the embodiment of FIGS. 4 and 5 as well, as soon as spindle pin 8 reaches the winding position shown in FIG. 2A, a claw-shaped recess 23 grips around so that here again the transverse movement is locked.

Moreover, FIG. 4 shows an embodiment of spindle pin 8 which is spherical in shape in the region of its largest pin diameter. This further simplifies the threading of spindle pin 8 into the holes in the cable drum.

We claim:

1. A device for winding and unwinding cables onto a cable drum, comprising:

a supporting frame having a transverse crossbar;

a first bracket arm which is suspended from the crossbar and which extends in a first longitudinal direction, the first bracket arm including a stationary arm portion and at least one further arm portion which is movable in the manner of a telescope in the first longitudinal direction;

a second bracket arm which is suspended from the crossbar and which extends in a second longitudinal direction that is parallel to the first longitudinal direction, the second bracket arm including a stationary arm portion and at least one further arm portion which is movable in the manner of a telescope in the second longitudinal direction, the second bracket arm being separated from the first bracket arm by a distance that is adjustable;

first and second spindle pins to support the cable drum;

first mounting means for mounting the first spindle pin on the first bracket arm so that the first spindle is rotatable and extends toward the second bracket arm, the first mounting means additionally including means for permitting the first spindle pin to move back and forth within predetermined limits transverse to the first longitudinal direction;

second mounting means for mounting the second spindle pin on the second bracket arm so that the second spindle pin is rotatable and extends toward the first bracket arm, the second mounting means additionally including means for permitting the second spindle pin to move back and forth within predetermined limits transverse to the second longitudinal direction;

lifting means for extending and retracting the first and second bracket arms in their respective longitudinal directions to move the spindle pins between respective receiving positions and respective winding positions that are disposed above the receiving positions;

first resilient means for resiliently supporting a further arm portion of the first bracket arm so that the first spindle pin can move back and forth within predetermined limits in the first longitudinal direction, when the spindle pins do not support the cable drum, independently of the lifting means;

second resilient means for resiliently supporting a further arm portion of the second bracket arm so that the second spindle pin can move back and forth within predetermined limits in the second longitudinal direction, when the spindle pins do not support the cable drum, independently of the lifting means;

first arresting means for arresting the longitudinal and transverse movements of the first spindle pin when the first spindle pin is in its winding position; and second arresting means for arresting the longitudinal and transverse movements of the second spindle pin when the second spindle pin is in its winding position.

2. The device of claim 1, wherein the at least one further arm portion of the first bracket arm includes a further arm portion with a free end, wherein the first mounting means mounts the first spindle pin at the free end of the further arm portion with a free end, wherein the stationary arm portion of the first bracket arm has a free end, and wherein the first arresting means is provided at the fee end of the stationary arm portion of the first bracket arm.

3. The device of claim 1, wherein the at least one further arm portion of the first bracket arm includes a first further arm portion with a free end, a second further arm portion inside the first further arm portion adjacent the free end thereof, and a third further arm portion inside the second further arm portion, wherein the first resilient means comprises a spring supporting the third further arm portion on the second further arm portion, and wherein the first mounting means comprises a bearing housing for the first spindle pin, the bearing housing being connected to the third further arm portion.

4. The device of claim 3, wherein the means for permitting the first spindle pin to move back and forth within predetermined limits transverse to the first longitudinal direction comprises a horizontal pin pivotally connecting the second further arm portion to the first further arm portion.

5. The device of claim 1, wherein the first mounting means comprises a bearing housing for the first spindle pin, and wherein the means for permitting the first spindle pin to move back and forth within predetermined limits transverse to the first longitudinal direction comprises means for mounting the bearing housing on the resiliently supported further arm portion of the first bracket arm so that the bearing housing is pivotal about a vertical axis.

6. The device of claim 5, wherein the first spindle pin has a center position, and wherein the first mounting means further comprises spring means for pivoting the bearing housing so that the first spindle pin is urged toward its center position.

7. The device of claim 5, wherein the bearing housing has first and second ends, the first spindle pin extending from the first end of the bearing housing, wherein the resiliently supported further arm portion has an opening with an edge, and wherein the means for mounting the bearing housing comprises a shaft connected to the bearing housing and extending away from the second end thereof, the shaft being pivotal about the vertical axis, one of the shaft and the bearing housing being supported on the edge of the opening in the resiliently supported further arm portion.

8. The device of claim 1, wherein the stationary arm portion of the first bracket arm has a free end, wherein the first mounting means comprises a bearing housing for the first spindle pin, and wherein the first arresting means comprises fork-like means, provided at the free end of the stationary arm portion of the first bracket arm, for gripping the bearing housing when the first spindle pin is in its winding position.

9. The device of claim 1, wherein the first bearing pin has a region of largest diameter, and a spherical shape at its region of largest diameter.

* * * * *